United States Patent [19]

Fucík et al.

[11] Patent Number: 5,024,068

[45] Date of Patent: Jun. 18, 1991

[54] NEEDLE PICKER RELEASING DEVICE

[75] Inventors: Borivoj Fucík, Markvartice; Milan Petránek, Starec; Frantisek Smítal, Trebíc, all of Czechoslovakia

[73] Assignee: Elitex Koncern Textiln, Liberec, Czechoslovakia

[21] Appl. No.: 254,345

[22] Filed: Oct. 5, 1988

[30] Foreign Application Priority Data

Oct. 6, 1987 [CS] Czechoslovakia ..... 7169-87

[51] Int. Cl.[5] ..... D04B 9/20

[52] U.S. Cl. ..... 66/53; 66/232

[58] Field of Search ..... 66/47, 48, 52, 53, 232

[56] References Cited

U.S. PATENT DOCUMENTS 3,608,336 9/1971 Phillips ..... 66/232

3,908,406 9/1975 Maler et al. ..... 66/232

FOREIGN PATENT DOCUMENTS 3240138 5/1983 Fed. Rep. of Germany ..... 66/52

285643 2/1928 United Kingdom ..... 66/48

2141447 12/1984 United Kingdom ..... 66/47

*Primary Examiner*—Wm. Carter Reynolds

*Attorney, Agent, or Firm*—Klein & Vibber

[57] ABSTRACT

A needle picker releasing device in a circular knitting machine for the production of hosiery goods performs releasing of pickers from a non-operative into an operative position by kinematic action of an electromagnet moving a blocking device. The electromagnet may be operated by a microswitch contacting a cam. The blocking device may be a double armed lever arranged between the electromagnet and the picker, one arm of the lever being engagable with the picker so as to block the motion of the picker and another arm of the lever being engageable by the electromagnet, movement of the other arm being obtained in one direction by the electromagnetic when energized and in another direction by spring means.

2 Claims, 1 Drawing Sheet

NEEDLE PICKER RELEASING DEVICE

FIELD OF THE INVENTION

The invention relates to a needle picker releasing device in a circular knitting machine for the production of hosiery and similar goods, that is for releasing a needle picker from a non-operative into operative position.

BACKGROUND OF THE INVENTION

Small diameter knitting machines are known for knitting hosiery which knit heels or toes of the fabric in two knitting feeds by reciprocatory knitting. Said knitting feeds are provided with couples of pickers to set the needles out of operation during reciprocatory run. Cam systems of said machines are arranged so that it is possible to perform selection for pearl and jacquard patterns. It is therefore necessary to create a channel between the knitting feeds for passage of the needles and this increases the circumference of the needle cylinder.

Additionally, there are difficulties with the cam arrangement with regard to the necessary angular override of the needle cylinder in reciprocatory run. Because the border needles or the butts of the needle guiding sliders in the dead center of the same revolution come for the second time into the zone of action of the pickers a second undesirable setting of the needles out of operation takes place.

This disadvantage is solved by the device according to Czechoslovak Author's Certificate No. 228,279 corresponding German Pat. No. DEOS 32 40 128 where a lever mechanism is associated with the pickers. The levers of said lever mechanism alternately hold the picker out of action during each revolution after setting the needles out of operation, while at the same time it releases the second picker into operative position. Driving force for the levers of the mechanism is taken from the butts of the guiding jacks or of the needles which increases the stress of the butts.

Nevertheless, this known device has the disadvantages that at higher knitting speeds, the butts of the needle jacks or the needles (according to whether it is a one cylinder or a double cylinder knitting machine) are considerably stressed upon narrowing, as they have to swing out the blocking lever beside displacing the picker. In machines, in which the pickers are arranged more remote from each other, the blocking levers take up a large space.

SUMMARY OF THE INVENTION

An object of the present invention is to eliminate the above mentioned disadvantages and this is achieved by an electromagnetic device for releasing the picker.

An advantage of the invention is that the device is simple, does not occupy the space around the needle cylinder, and it does not stress the butts of the needle guiding sliders or of the needles.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Known double-cylinder circular knitting machines for the production of hosiery are provided with a cam system with two knitting feeds which enable the knitting of heels and toes in reciprocatory run. In the path of the upper butts of the guiding jacks pickers are arranged in a known way before the stitch cams to set the needles out of operation. In describing the present invention as follows, reference will be made to one of these pickers, although in practice a plurality of pickers are utilized.

Figure 2:
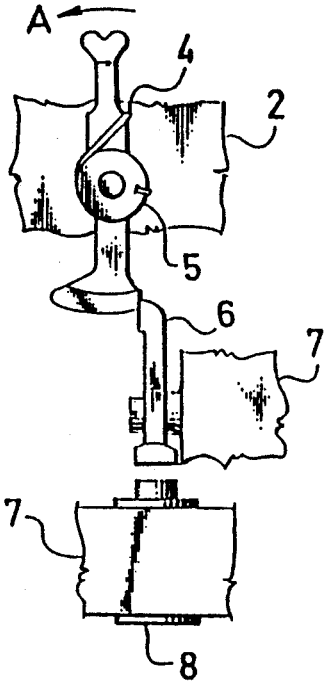
FIG. 2 is a front view of a picker with an illustration of the electromagnetic device and appurtenant equipment.
Figure 1:
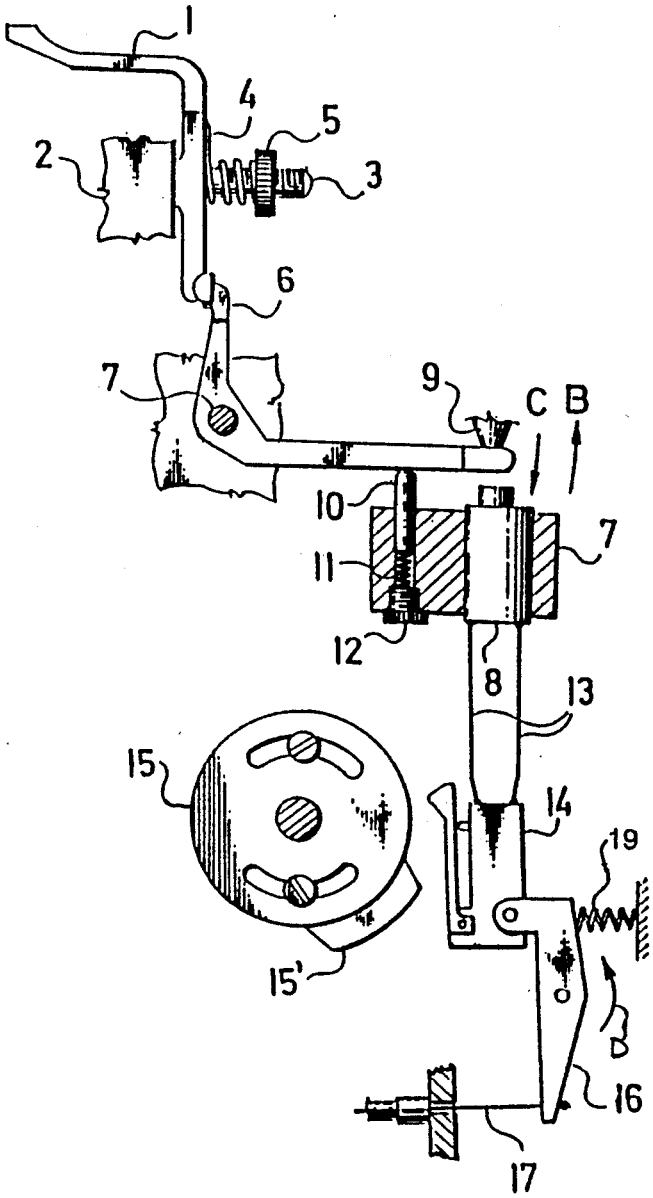
FIG. 1 is a side view of a picker illustrating the electromagnetic device for its releasing.

Referring now to FIG. 1, a picker 1 is rockably located in a cam box 2 on a pin 3. On the pin 3 there is a torsion spring 4 secured by a nut 5 and due to its action it is pressed in the direction of the arrow A (FIG. 2).

Upper arm of the picker 1 is horizontal and it is arranged for engagement with the butts of the guiding sliders (not shown). Lower arm of the picker 1 is vertical and is engagable by a vertical arm of lever 6 located in stand 7. A horizontal arm of the lever 6 is attractable by an electromagnet 8 on one side and engagable from the other side by a stop 9.

Electromagnet 8 is fixed in the stand 7, in which there is also located an adjustable spring loaded pin 10 (under the pin 10 in a receiving hole there is arranged a compression spring 11 which bears against nut 12 placed in the receiving hole). The pin 10 acts on the horizontal arm of the lever 6 in the direction of the arrow B.

A microswitch 14 is connected by means of the conductors 13 in the circuit of the electromagnet 8, the arm of said microswitch being engagable by segment 15' fixed on ring 15, which is driven synchronously with the needle cylinder.

Microswitch 14 is mounted on a lever 16. The Bowden wire 17 is connected to lever 16. Wire 17 is kinematically connected to a not shown control drum of the machine. Against the other arm of the lever 16 bears a compression spring 19 which holds the arm of the lever 16 with the microswitch 14 in the zone of action of the segment 15'.

METHOD OF OPERATION

The operation of the above described device is as follows:

During rotary knitting, the lever 6 blocks the picker 1 in non-operative elevated position against the action of the torsion spring 4, as illustrated in FIGS. 1 and 2. Lever 6 is swung by the action of the compression spring 11 and pin 10 so that it bears against the stop 9. Lever 16 is swung out of the reach of the segment 15' so that the microswitch 14 is opened and the electromagnet 8 is not energized.

During reciprocatory run the wire 17 is released by a command of the control drum (not shown) so that the lever 16 swings in the direction of the arrow D due to the action of the spring 19. Microswitch 14 is then closed by engagement with the segment 15' and closes the circuit of the electromagnet 8. Electromagnet 8 attracts the horizontal arm of the lever 6 in the direction of the arrow C against the action of the compression spring 11 and pin 10 while the vertical arm of the lever 6 releases the picker 1. Picker 1 is moved in the direction of the arrow A into operational position due to the action of the torsion spring 4. The butt of the guiding jack (not shown) impacts the picker 1, swings it back into non-operative position where it is again secured by the lever 6, because in the meantime the segment 15' has stopped acting on the microswitch 14 which opened the circuit of the electromagnet 8 and the latter stopped holding the lever 6 which has returned in the direction of the arrow B into its original position due to the action of the compression spring 11 and the pin 10.

Said operation repeats during reciprocatory knitting. After its finishing, the lever 16 returns into the original position and the releasing device stops working.

Various modifications are possible within the scope of the invention. For example the electromagnet 8 may act directly on he picker 1, or the function of the lever 6 may be performed directly by a swingable armature of the electromagnet. Segment 15' can be replaced by a cam, etc. The device can be also used to control needles in a single-cylinder machine.

Although the invention is described and illustrated with reference to a plurality of embodiments thereof, it is to be expressly understood that it is in no way limited to the disclosure of such preferred embodiments but is capable of numerous modifications within the scope of the appended claims.

What we claim is:

1. Needle picker releasing device in a circular knitting machine for the production of hosiery goods and the like said device for the releasing of a needle picker from a non-operative into operative position, comprising an electromagnet kinematically connected with the picker so that energizing the, electromagnet changes the position of blocking means to release the picker to allow rocking motion;

a microswitch for energizing said electromagnet, said microswitch being actuated by a rotating cam;

said microswitch being mounted on a switch lever such that said microswitch is movable into and out of a path of said cam.

2. Needle picker releasing device in a circular knitting machine for the production of hosiery goods and the like said device for the releasing of a needle picker from a non-operative into operative position, comprising an electromagnet kinematically connected with the picker so that energizing the electromagnet changes the position of blocking means to release the picker to allow rocking motion;

said blocking means being a double armed lever arranged between the electromagnet and the picker, one arm of the lever being engagable with the picker so as to block the motion of the picker and another arm of the lever being engagable by the electromagnet, movement of said other arm being obtained in one direction by said electromagnetic when energized and in another direction by spring means, movement in said other direction being limited by a stop.

* * * * *